US009212578B2

(12) United States Patent
Cha et al.

(10) Patent No.: US 9,212,578 B2
(45) Date of Patent: Dec. 15, 2015

(54) EXHAUST MANIFOLD FOR PREVENTING CONDENSATE AND GAS LEAKAGE IN ENGINE

(75) Inventors: Soon Chang Cha, Incheon (KR); Kwang Soo Kim, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 13/996,060

(22) PCT Filed: Nov. 10, 2011

(86) PCT No.: PCT/KR2011/008552

§ 371 (c)(1), (2), (4) Date: Oct. 21, 2013

(87) PCT Pub. No.: WO2012/086925

PCT Pub. Date: Jun. 28, 2012

(65) Prior Publication Data

US 2014/0041372 A1 Feb. 13, 2014

(30) Foreign Application Priority Data

Dec. 21, 2010 (KR) ..... 10-2010-0131470

(51) Int. Cl.
*F01N 1/00* (2006.01)
*F01N 13/10* (2010.01)
*F01N 13/18* (2010.01)

(52) U.S. Cl.
CPC *F01N 1/00* (2013.01); *F01N 13/10* (2013.01); *F01N 13/1827* (2013.01)

(58) Field of Classification Search
CPC ..... F01N 1/00; F01N 13/08; F01N 13/10; F01N 13/1827; F01N 13/1805; F01N 13/1888; F01N 13/1816; F01N 13/102; F01N 13/141; F16J 15/065; F16J 15/128; F16J 15/002; F16L 21/035; F16L 21/00
USPC ..... 60/322, 323, 272; 29/890.08; 123/315; 277/627, 591; 285/370, 371, 345, 351, 285/224, 226, 302; 138/155, 120
See application file for complete search history.

(56) References Cited

U.S. PATENT DOCUMENTS 5,689,954 A * 11/1997 Blocker et al. ..... 60/322
6,220,605 B1 * 4/2001 Becker, Jr. ..... 277/591

(Continued)

FOREIGN PATENT DOCUMENTS

JP H057923 A 1/1993
JP 05-007923 U 2/1993

(Continued)

OTHER PUBLICATIONS

Search Report dated May 31, 2012 and written in Korean with English translation attached for International Patent Application No. PCT/KR2011/008552 filed Nov. 10, 2011, 5 pages.
Chinese Office Action dated Jan. 7, 2015 for corresponding Chinese Application No. 201180066732.5, 6 pages.

*Primary Examiner* — Jesse Bogue
*Assistant Examiner* — Kelsey Stanek
(74) *Attorney, Agent, or Firm* — John D. Veldhuis-Kroeze; Westman, Champlin & Koehler, P.A.

(57) ABSTRACT

The present invention relates to an exhaust manifold for preventing condensate and gas leakage in an engine, and more particularly, to an exhaust manifold for preventing condensate and gas leakage in an engine, capable of preventing peripheries of the engine from being contaminated by condensate and/or exhaust gas leaking from interiors of a plurality of exhaust manifolds to the outside through connection portions of the exhaust manifolds.

6 Claims, 5 Drawing Sheets

(56) References Cited

U.S. PATENT DOCUMENTS

| | | | | |
|---|---|---|---|---|
| 6,293,098 | B1 * | 9/2001 | Coates | 60/322 |
| 2006/0272321 | A1 * | 12/2006 | Mockenhaupt et al. | 60/323 |
| 2008/0224422 | A1 * | 9/2008 | Halling | 277/644 |
| 2009/0108543 | A1 * | 4/2009 | Hittle | 277/591 |

FOREIGN PATENT DOCUMENTS

| | | | |
|---|---|---|---|
| KR | 20-1998-0026314 | U | 8/1998 |
| KR | 10-2009-0037149 | A | 4/2009 |
| KR | 10-2009-0064173 | A | 6/2009 |

* cited by examiner

EXHAUST MANIFOLD FOR PREVENTING CONDENSATE AND GAS LEAKAGE IN ENGINE

CROSS-REFERENCE TO RELATED APPLICATION

This Application is a Section 371 National Stage Application of International Application No. PCT/KR2011/008552, filed Nov. 10, 2011 and published, not in English, as WO2012/086925 on Jun. 28, 2012.

FIELD OF THE DISCLOSURE

The present disclosure relates to an exhaust manifold for preventing condensate and gas leakage in an engine, and more particularly, to an exhaust manifold for preventing condensate and gas leakage in an engine, capable of preventing peripheries of the engine from being contaminated by condensate and/or exhaust gas leaking from interiors of a plurality of exhaust manifolds to the outside through connection portions of the exhaust manifolds.

BACKGROUND OF THE DISCLOSURE

In general, an engine obtains power by combustion of fuel, fuel mixed with air is combusted in a combustion chamber of the engine, and gas produced by combustion in the combustion chamber is passed to an exhaust tube through an exhaust manifold and then discharged to the outside. As a temperature of exhaust gas in the engine is increased due to strict regulations on exhaust gas, the exhaust manifold has a structure that is divided into three portions in order to prevent cracks or breaks thereof. For example, in a case of a six-cylinder engine, the exhaust manifold is manufactured to be divided into three pieces each of which corresponds to two cylinders, and a single completed exhaust manifold is used by assembling the three pieces.

FIG. 1 is a schematic perspective view illustrating an exhaust manifold of an engine according to an example of the related art.

As illustrated in FIG. 1, an exhaust manifold 1 of an engine according to an example of the related art includes a hollow-shaped main tube 2, branch tubes 3 which are provided on one side of the main tube at predetermined intervals, respectively and have exhaust gas intake ports 3*a*, and an exhaust gas discharge port 2*a* which is provided on the other side of the main tube 2 and communicated with each of the branch tubes 3 through the main tube.

In addition, at an outer side periphery of the exhaust manifold 1, there is provided a plurality of bosses 4 having a threaded hole at a center thereof, and each of the bosses may detachably fix peripheral structures such as various types of pipes and the like by means of bolts and the like.

Therefore, when the engine is driven, exhaust gas combusted in each of the combustion chambers flows into the exhaust gas intake port 3*a* of the corresponding branch tube 3, and then may be discharged to an exhaust tube (not illustrated) through the exhaust gas discharge port 2*a* via the main tube 2.

Meanwhile, FIG. 2 is a schematic perspective view illustrating a state in which one side connection portion positioned at a central side of the exhaust manifold of the engine according to the related art and the other side corresponding connection portion to be coupled to the one side connection portion are separated from each other, and FIG. 3 is a schematic cross-sectional view illustrating a state in which a connection portion of the exhaust manifold of the engine according to the related art and a corresponding connection portion are coupled to each other.

As illustrated in FIG. 2, each of the connection portions 5 and 5A of the exhaust manifold 1 of the engine according to the related art has two sealing grooves 5*a* formed along a length thereof at a predetermined interval, and one groove 5*b* for blocking exhaust gas leakage is formed between the sealing grooves 5*a*. Two seal rings 6 are configured as one set, and detachably fitted into the respective sealing grooves 5*a*.

However, in order to prevent physical interference between a front end portion of one side connection portion 5 and a corresponding portion of the other side corresponding connection portion 5A, the exhaust manifold 1 of the engine according to the related art is formed to have a shape in which a predetermined marginal space is merely provided in a longitudinal direction (see FIG. 3). For this reason, the exhaust manifold 1 of the engine according to the related art has a structure in which when the engine is driven, high exhaust pressure is inevitably applied to the connection portions through the marginal space.

That is, in the exhaust manifold 1 of the engine according to the related art, because one side connection portion 5 and the other side corresponding connection portion 5A are not yet sufficiently and thermally expanded when the engine starts to be driven in a cold state, a gap between the seal rings 6 of one side connection portion 5 and the other side corresponding connection portion 5A is large, and for this reason, there is a problem in that condensate, which is produced in the exhaust manifold 1 by contact with the outside air through the gap is discharged to the outside through the gap by high exhaust pressure.

In addition, in the exhaust manifold 1 of the engine of the related art, there is a problem in that when high exhaust pressure is generated as the engine starts to be driven in a cold state as described above, not only condensate but also exhaust gas leaks to the atmosphere through the gap.

Thus, since condensate and/or exhaust gas leak to the outside peripheries of the engine through the gap between the connection portions 5 and 5A of the exhaust manifold 1, and the peripheries of the engine are contaminated, there is a number of complaints from customers about the above problem, it is cumbersome to perform maintenance, and there is a burden that the relevant components need to be replaced in a severe case.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, the present disclosure has been made in an effort to solve the aforementioned problems, and an object of the present disclosure is to provide an exhaust manifold for preventing condensate and gas leakage in an engine, capable of basically resolving the problem of the related art that condensate that is produced in the exhaust manifold and/or the exhaust gas in the exhaust manifold are discharged by high exhaust pressure to the outside through a gap between connection portions by suppressing occurrence of a gap between a seal ring of one side connection portion and the other side corresponding connection portion of the exhaust manifold even when the engine starts to be driven in a cold state.

Another object of the present disclosure is to provide an exhaust manifold for preventing condensate and gas leakage in an engine, which has a comparatively simple and compact structure, may suppress occurrence of a gap between connection portions of the exhaust manifold, and may facilitate convenient installation and maintenance thereof.

To achieve the aforementioned object, the present disclosure provides an exhaust manifold for preventing condensate and gas leakage in an engine, the exhaust manifold including: one side main tube having a connection portion having sealing grooves which are formed on at least one place of an outer circumference portion along a circumference thereof; and the other side main tube having a corresponding connection portion which accommodates the connection portion of the one side main tube, in which at least one seal ring is fitted into each of the sealing grooves of the connection portion of the one side main tube so as to prevent leakage of condensate and/or exhaust gas, and a swirl groove is formed in an outer radial direction in an inner circumference of the corresponding connection portion of the other side main tube, which is adjacent to a front end portion of the connection portion of the one side main tube.

In addition, with respect to the above exemplary embodiment of the present disclosure, the present disclosure further provides the following specific exemplary embodiments.

According to the exemplary embodiment of the present disclosure, an inclined surface, which guides the condensate and/or the exhaust gas toward a central side of the connection portion, may be further formed on the front end portion of the connection portion of the one side main tube along a circumference of the front end portion.

According to the exemplary embodiment of the present disclosure, the swirl groove is formed to have a circular or elliptical shape having a concave curved surface, and an inclined surface, which guides the condensate and/or the exhaust gas toward the central side of the connection portion, may be further formed on the front end portion of the connection portion of the one side main tube along a circumference of the front end portion, and an outer end in a longitudinal direction of the inclined surface may be positioned further inward than an imaginary line which connects two points of the deepest portions on a circumference of the swirl groove.

According to the exemplary embodiment of the present disclosure, two seal rings may be fitted as one set into each of the sealing grooves of the connection portion of the one side main tube, and two seal rings of each set may be disposed so that the gaps formed for each corresponding seal ring cross each other.

According to the exemplary embodiment of the present disclosure, the sealing grooves may be formed on at least two places on the outer circumference portion of the connection portion of the one side main tube along the circumference thereof, and a groove for blocking exhaust gas leakage may be further formed between two grooves.

The present disclosure provides the swirl groove formed in the outer radial direction on the inner circumference of the corresponding connection portion of the other side main tube, which is adjacent to the front end portion of the connection portion of one side main tube of the exhaust manifold, thereby effectively preventing the condensate that is produced in the exhaust manifold and/or the exhaust gas in the exhaust manifold from leaking to the outside through the gap between the connection portions by guiding the flow of the high pressure exhaust gas from the outer side of the connection portion toward the central side.

In addition, the present disclosure further provides the inclined surface formed on the front end portion of the connection portion of one side main tube of the exhaust manifold along the circumference of the front end portion, and therefore a flow direction of the high pressure exhaust gas is changed by the inclined surface, thereby basically resolving the problem that the condensate that is produced in the exhaust manifold and/or the exhaust gas in the exhaust manifold are discharged by high exhaust pressure to the outside through the gap between the connection portions.

In addition, the present disclosure has the swirl groove formed in the outer radial direction on the inner circumference of the corresponding connection portion of the other side main tube, which is adjacent to the front end portion of the connection portion of one side main tube of the exhaust manifold, and further provides the inclined surface formed on the front end portion of the connection portion of one side main tube of the exhaust manifold along the circumference of the front end portion, thereby suppressing occurrence of a gap between the seal ring of the connection portion of the one side main tube and the corresponding connection portion of the other side main tube by changing a flow of the exhaust gas which is applied to a contact portion between the seal ring of the connection portion of the one side main tube and the corresponding connection portion of the other side main tube.

DESCRIPTION OF MAIN REFERENCE NUMERALS OF DRAWINGS

Figure 1:
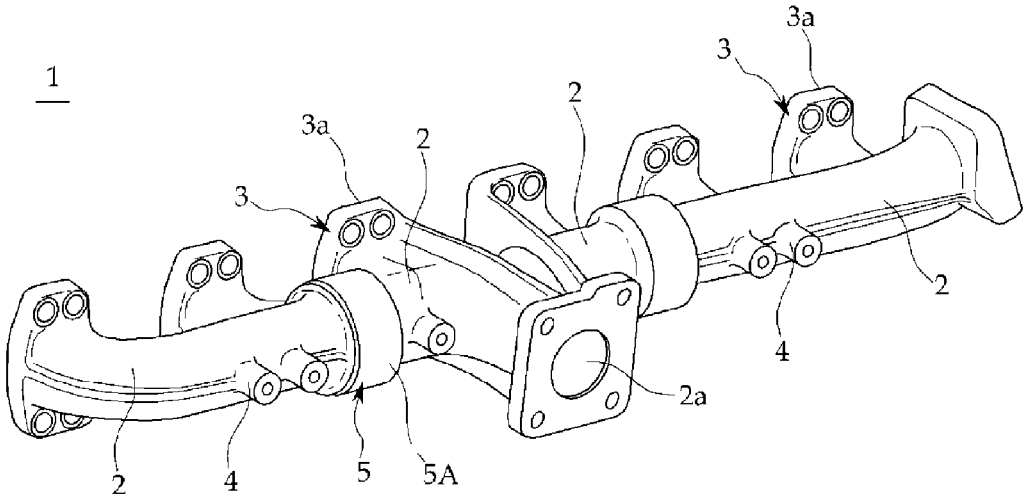
FIG. 1 is a schematic perspective view illustrating an exhaust manifold of an engine according to an example of the related art.
Figure 2:
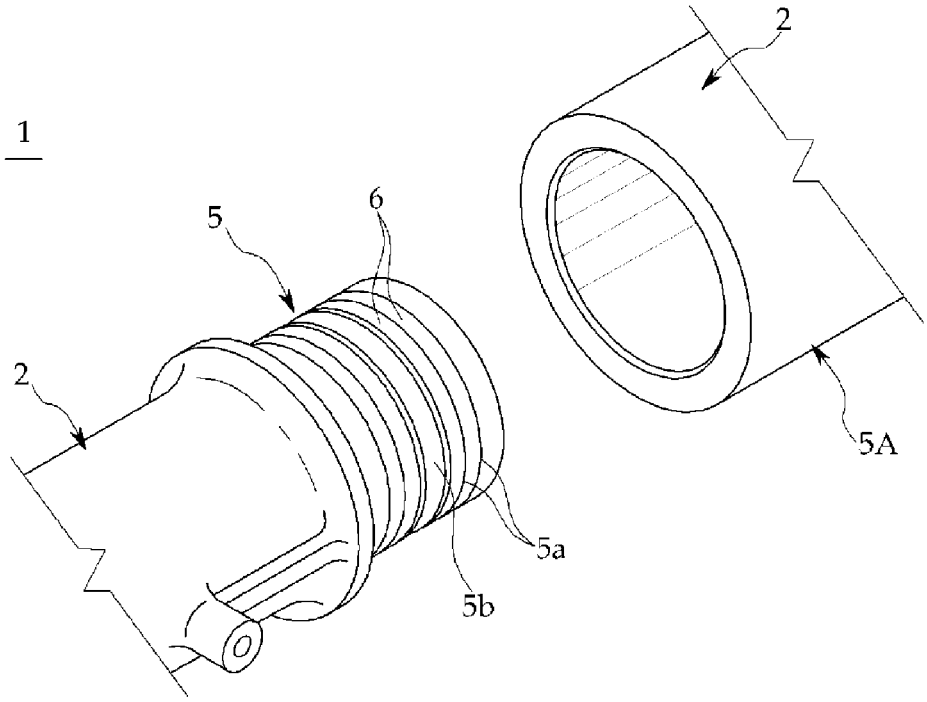
FIG. 2 is a schematic perspective view illustrating a state in which one side connection portion positioned at a central side of the exhaust manifold of the engine according to the related art and the other side corresponding connection portion to be coupled to the one side connection portion are separated from each other.
Figure 3:
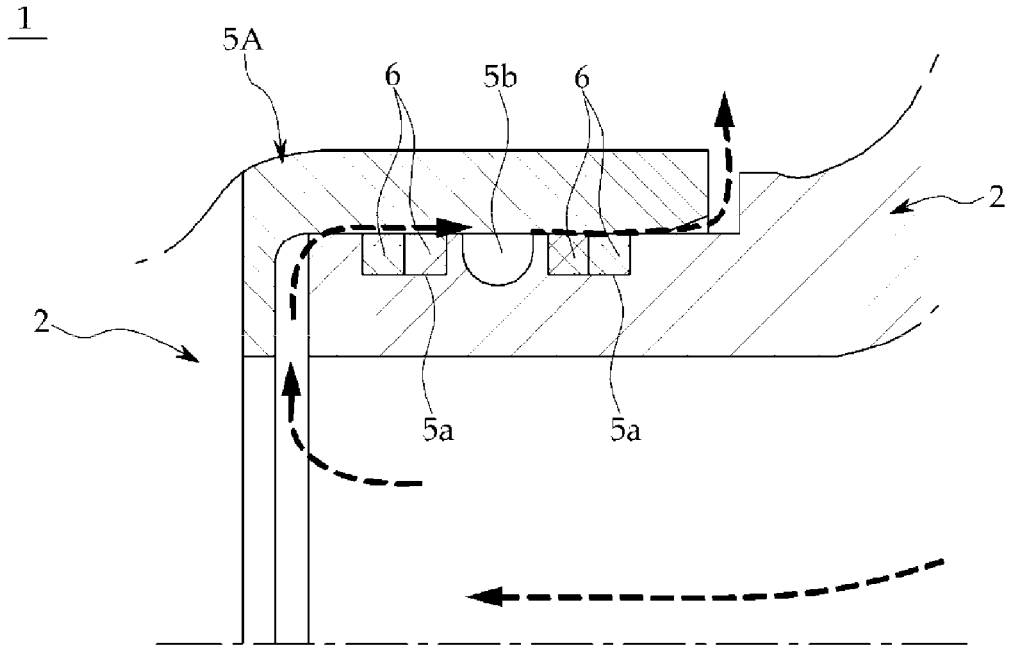
FIG. 3 is a schematic partially cross-sectional view illustrating a state in which a connection portion of the exhaust manifold of the engine according to the related art and a corresponding connection portion are coupled to each other, and an operation therebetween.

1, 1*a*: Exhaust manifold
2: Main tube
2*a*: Exhaust gas discharge port
3*a*: Exhaust gas intake port
5: Connection portion
5A: Corresponding connection portion
5*a*: Sealing groove
5*b*: Groove for blocking exhaust gas leakage
6: Seal ring
7: First port
8: Second port
10: Inclined surface
11: Swirl groove
L: Imaginary line

DETAILED DESCRIPTION

Hereinafter, an exemplary embodiment of an exhaust manifold for preventing condensate and gas leakage in an engine according to the present disclosure will be described with reference to FIGS. 4 to 7.

Figure 4:
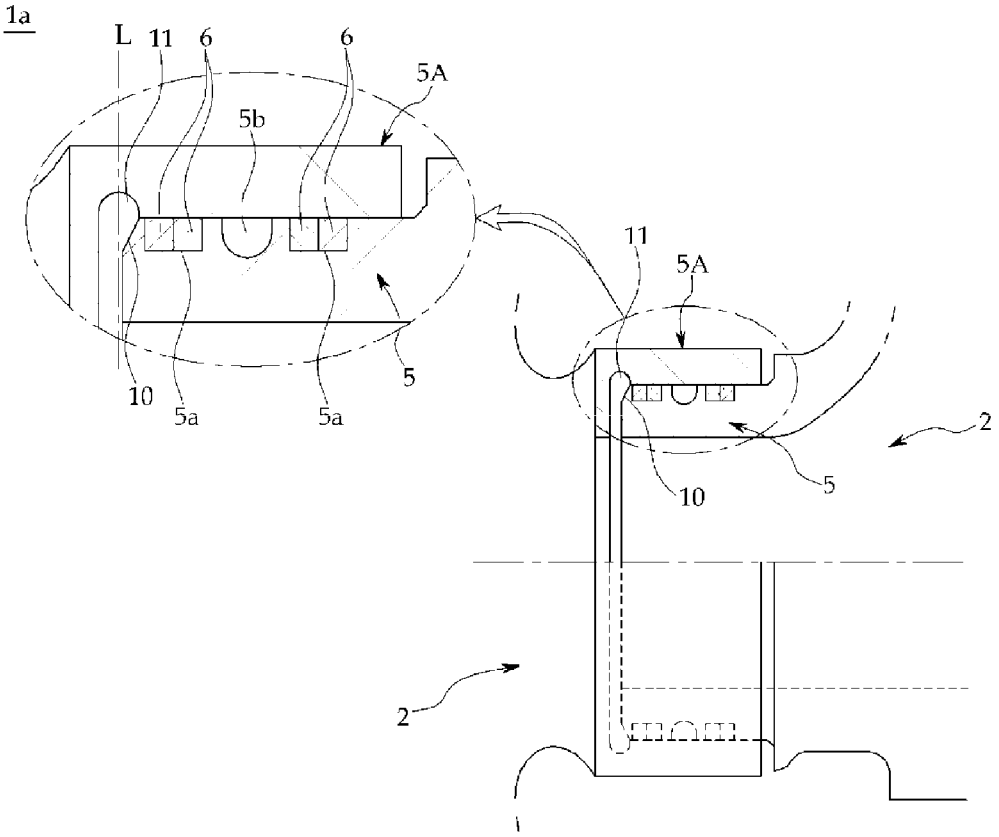
FIG. 4 is a schematic partially-enlarged cross-sectional view illustrating an exhaust manifold for preventing condensate and gas leakage in an engine according to the present disclosure.
Figure 5:
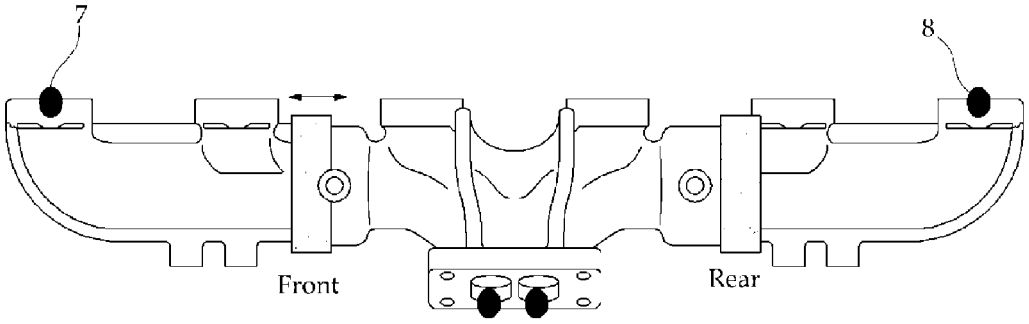
FIG. 5 is a schematic view provided for better understanding of leakage tests for the existing mass-produced product and the exhaust manifold according to the present disclosure.

As illustrated in FIG. 4, an exhaust manifold 1*a* for preventing condensate and gas leakage in an engine according to the present disclosure includes one side main tube 2 having a connection portion 5 having sealing grooves 5*a* which are formed on at least one place of an outer circumference portion along a circumference thereof, and the other side main tube 2 having a corresponding connection portion 5A which accommodates the connection portion 5 of the one side main tube 2.

In addition, in the exhaust manifold 1*a* for preventing condensate and gas leakage in an engine according to the present disclosure, at least one seal ring 6 is fitted into each of the sealing grooves 5*a* of the connection portion 5 of the one side main tube 2 so as to prevent leakage of condensate and/or exhaust gas, and a swirl groove 11 is formed in an outer radial direction in an inner circumference of the corresponding connection portion 5A of the other side main tube 2, which is adjacent to a front end portion of the connection portion 5 of the one side main tube 2.

Therefore, in the exhaust manifold 1*a* for preventing condensate and gas leakage in an engine according to the present disclosure, which is configured as described above, a flow of condensate that is produced in the exhaust manifold 1*a* when the engine starts to be driven in a cold state and typical high exhaust pressure is generated and/or exhaust gas in the exhaust manifold 1*a*, does not pass through a gap between the seal ring 6 of the connection portion 5 of the one side main tube 2 and the corresponding connection portion 5A of the other side main tube 2, but may be discharged to an exhaust gas discharge port (not illustrated) of the exhaust manifold 1*a* while being changed to a flow toward a central side of the connection portion 5 through the swirl groove 11 of the connection portion 5. Here, the condensate and/or the exhaust gas, which is discharged to the exhaust gas discharge port (not illustrated) of the exhaust manifold 1*a*, may be discharged to the atmosphere through an exhaust tube (not illustrated) or may be supplied to an intake manifold through an exhaust gas recirculation (EGR) line.

In addition, the exhaust manifold for preventing condensate and gas leakage in an engine according to the present disclosure may be configured in a type, which is more limited to the following specific exemplary embodiments, in addition to the basic configuration as described above.

As an exemplary embodiment, an inclined surface 10, which guides the condensate and/or the exhaust gas toward a central side of the connection portion 5, may be further formed on the front end portion of the connection portion 5 of the one side main tube 2 along a circumference of the front end portion.

This structure of the inclined surface may guide a flow of the condensate and/or the exhaust gas, which flows toward the gap between the seal ring 6 of the connection portion 5 of the one side main tube 2 and the corresponding connection portion 5A of the other side main tube 2, toward the central side of the connection portion 5, thereby effectively preventing the condensate that is produced in the exhaust manifold 1*a* and/or the exhaust gas in the exhaust manifold 1*a* from leaking to the outside through the gap.

As an exemplary embodiment, the swirl groove 11 is formed to have a circular or elliptical shape having a concave curved surface, and an inclined surface 10, which guides the condensate and/or the exhaust gas toward the central side of the connection portion 5, may be further formed on the front end portion of the connection portion 5 of the one side main tube 2 along a circumference of the front end portion. In addition, an outer end in a longitudinal direction of the inclined surface 10 may be provided to be positioned further inward than an imaginary line L which connects two points of the deepest portions on a circumference of the swirl groove 11 (see FIG. 4).

The curved surface structure of the swirl groove and the structure in which the outer end in the longitudinal direction of the inclined surface 10 is positioned further inward than the imaginary line L which connects two points of the deepest portions on the circumference of the swirl groove 11 serve to smoothly change a flow of the condensate and/or the exhaust gas, which flows toward the gap between the seal ring 6 of the connection portion 5 of the one side main tube 2 and the connection portion 5A of the other side main tube 2, toward the central side of the connection portion 5.

As an exemplary embodiment, two seal rings 6 are fitted as one set into each of the sealing grooves 5*a* of the connection portion 5 of the one side main tube 2, and two seal rings 6 of each set may be disposed so that the gaps formed for each corresponding seal ring cross each other.

The structure in which two seal rings are provided for each of the sealing grooves and the disposition structure in which the gaps of the two seal rings cross each other may effectively prevent the exhaust gas from leaking to the outside through the gap made between the seal ring 6 of the connection portion 5 of the one side main tube 2 and the corresponding connection portion 5A of the other side main tube 2.

As an exemplary embodiment, the sealing grooves 5*a* is formed on at least two places on the outer circumference portion of the connection portion 5 of the one side main tube 2 along the circumference thereof, and a groove 5*b* for blocking exhaust gas leakage may be further formed between the two grooves 5*a*.

Next, a method of performing leakage tests for the exhaust manifold 1*a* for preventing condensate and gas leakage in an engine according to the present disclosure and the existing mass-produced product, and results of the tests will be described.

In a state in which both the exhaust gas intake ports and the exhaust gas discharge ports of the respective exhaust manifolds 1 and 1*a* of the existing mass-produced product (or specification for mass-production) and the present disclosure (or improved specification) are sealed by sealing materials such as silicon rubber, a fluid for each volume (5 ml, 10 ml, 15 ml) was injected through a portion of the exhaust gas sealing (a portion of the exhaust gas discharge port) by using a syringe (not illustrated), air pressure of 0.2 bar or more was additionally applied through a first port 7 and a second port 8 of the respective exhaust manifolds 1 and 1*a* for 30 seconds, three times for each volume, and then leakage amounts at front and rear connection portions of the exhaust manifolds 1 and 1*a* were measured for each volume of the fluid.

The following Table 1 illustrates leakage amounts of fluid and improvement ratios (%) as numerical data as a result of injecting a fluid for each volume (5 ml, 10 ml, 15 ml) to the respective exhaust manifolds 1 and 1*a* of the existing mass-produced product and the present disclosure.

TABLE 1

| Fluid Volume | Number of | Specification for Mass-production | | Improved specification | | Improvement |
|---|---|---|---|---|---|---|
| (ml) | tests | Front | Rear | Front | Rear | ratio (%) |
| 5 | 1 | 4 | 0 | 2 | 0 | 74 |
| | 2 | 3.2 | 0.4 | 1.2 | 0 | |
| | 3 | 4 | 0.9 | 0 | 0 | |
| 10 | 1 | 4 | 2 | 1.2 | 0.2 | 65 |
| | 2 | 2.5 | 4.5 | 1.6 | 1.2 | |
| | 3 | 1.2 | 3.5 | 1.5 | 0.5 | |
| 15 | 1 | 11 | 10.7 | 1.2 | 1.2 | 90 |
| | 2 | 10 | 10 | 1.2 | 1.3 | |
| | 3 | 11 | 12 | 1.5 | 0 | |

Figure 6:
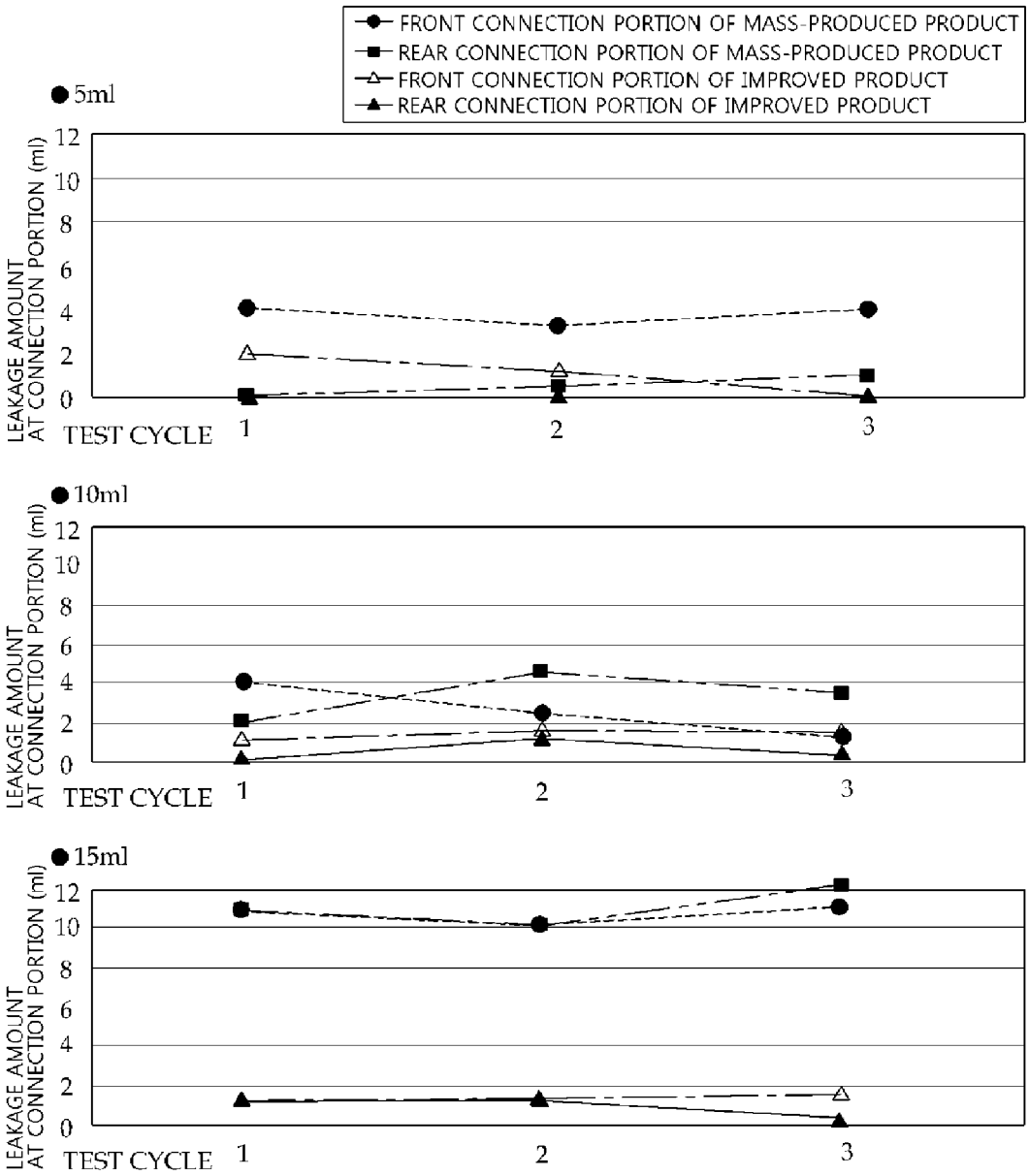
FIG. 6 illustrates graphs illustrating results of fluid leakage tests performed for the exhaust manifold for preventing condensate and gas leakage in an engine according to the present disclosure and the existing mass-produced product.
Figure 7:
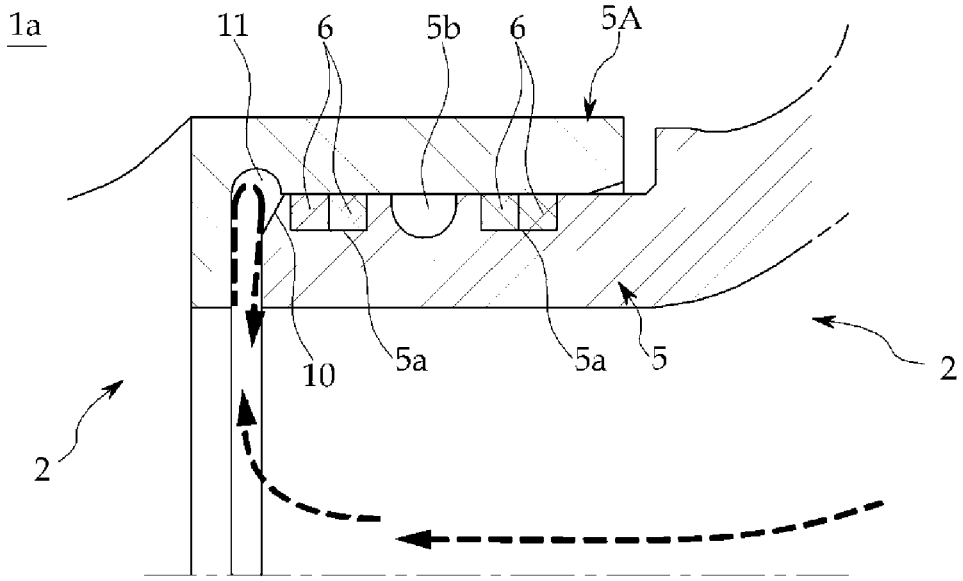
FIG. 7 is a schematic cross-sectional view illustrating an operating state of the exhaust manifold for preventing condensate and gas leakage in an engine according to the present disclosure.

In addition, graphs of FIG. 6 are visually illustrated for better understanding of the results of the numerical data in Table 1. As can be seen from Table 1, as a result of injecting a fluid for each volume (5 ml, 10 ml, 15 ml), in terms of an effect of suppressing leakage, the improved specification of the present disclosure shows the improvement ratio of 65 to 90% in comparison with the specification for mass-production of the existing product.

An operation of the exhaust manifold for preventing condensate and gas leakage in an engine according to the present disclosure, which is configured as described above, will be described with reference to FIGS. 4 and 7.

When the engine is driven, exhaust gas combusted in each of the combustion chambers flows into the exhaust gas intake port 3*a* of the corresponding branch tube 3 of the exhaust manifold 1*a*, and then may be discharged to an exhaust tube (not illustrated) through the exhaust gas discharge port 2*a* via the main tube 2. At this time, high exhaust pressure is applied to the seal ring 6 of the connection portion 5 of the one side main tube 2 and the connection portion 5A of the other side main tube 2 of the exhaust manifold 1*a*.

However, the condensate that is produced in the exhaust manifold 1*a* and/or the exhaust gas in the exhaust manifold 1*a* are guided toward the central side of the connection portion 5 by the swirl groove 11 provided on a circumference of the corresponding connection portion 5A of the one side main tube 2 and/or the inclined surface 10 of the front end portion side of the connection portion 5 of the other side main tube 2, which is adjacent to the swirl groove 11 of the connection portion 5 of the one side main tube 2, and thereby the condensate and/or the exhaust gas may be discharged toward the exhaust gas discharge port (not illustrated) of the exhaust manifold 1*a*. Thereafter, the condensate and/or the exhaust gas, which are discharged to the exhaust gas discharge port (not illustrated) of the exhaust manifold 1*a*, may be discharged to the atmosphere through an exhaust tube (not illustrated), or parts of the condensate and/or the exhaust gas may be supplied to an intake manifold through an exhaust gas recirculation (EGR) line.

The present disclosure described above is not limited to the aforementioned exemplary embodiment and the accompanying drawings, and it is apparent to those skilled in the art that simple substitutions, modifications and alterations may be made without departing from the technical spirit of the present disclosure.

The present disclosure provides the swirl groove formed in the outer radial direction on the inner circumference of the corresponding connection portion of the other side main tube, which is adjacent to the front end portion of the connection portion of the one side main tube of the exhaust manifold, thereby effectively preventing the condensate that is produced in the exhaust manifold and/or the exhaust gas in the exhaust manifold from leaking to the outside through the gap between the connection portions by guiding the flow of the high pressure exhaust gas from the outer side of the connection portion toward the central side.

In addition, the present disclosure further provides the inclined surface formed on the front end portion of the connection portion of the one side main tube of the exhaust manifold along the circumference of the front end portion, and therefore a flow direction of the high pressure exhaust gas is changed by the inclined surface, thereby basically resolving the problem that the condensate that is produced in the exhaust manifold and/or the exhaust gas in the exhaust manifold are discharged by high exhaust pressure to the outside through the gap between the connection portions.

In addition, the present disclosure has the swirl groove formed in the outer radial direction on the inner circumference of the corresponding connection portion of the other side main tube, which is adjacent to the front end portion of the connection portion of the one side main tube of the exhaust manifold, and further provides the inclined surface formed on the front end portion of the connection portion of the one side main tube of the exhaust manifold along the circumference of the front end portion, thereby suppressing occurrence of a gap between the seal ring of the connection portion of the one side main tube and the corresponding connection portion of the other side main tube by changing a flow of the exhaust gas which is applied to a contact portion between the seal ring of the connection portion of the one side main tube and the corresponding connection portion of the other side main tube.

Although the present disclosure has been described with reference to exemplary and preferred embodiments, workers skilled in the art will recognize that changes may be made in form and detail without departing from the spirit and scope of the disclosure.

The invention claimed is:

1. An exhaust manifold for preventing condensate and gas leakage in an engine, the exhaust manifold comprising:

one side main tube having a connection portion having sealing grooves which are formed on at least one place of an outer circumference portion along a circumference thereof; and an other side main tube having a corresponding connection portion which accommodates the connection portion of the one side main tube, wherein at least one seal ring is fitted into each of the sealing grooves of the connection portion of the one side main tube so as to prevent leakage of condensate or exhaust gas, and a swirl groove is formed in an outer radial direction in an inner circumference of the corresponding connection portion of the other side main tube, which is adjacent to a front end portion of the connection portion of the one side main tube, and wherein the swirl groove is formed outward in the radial direction relative to an interface formed between an outside diameter of the one side main tube and an inside diameter of the other side main tube, and an inclined surface, which guides the condensate or the exhaust gas toward a central side of the connection portion of the one side main tube and is connected to the swirl groove, is formed on the front end portion of the connection portion of the one side main tube along a circumference of the front end portion.

2. The exhaust manifold of claim 1, wherein the swirl groove is formed to have a circular or elliptical shape having a concave curved surface, and an outer end in a longitudinal direction of the inclined surface is positioned further inward than an imaginary line which connects two points of the deepest portions on a circumference of swirl groove.

3. The exhaust manifold of claim 1, wherein two seal rings are fitted as one set into each of the sealing grooves of the connection portion of the one side main tube, and wherein the two seal rings of each set are disposed so that the gaps formed for each corresponding seal ring cross each other.

4. The exhaust manifold of claim 1, wherein the sealing grooves are formed on at least two places on the outer circumference portion of the connection portion of the one side main tube along the circumference thereof, and a groove for blocking exhaust gas leakage is further formed between the two grooves.

5. The exhaust manifold of claim 1, wherein an end portion of the swirl groove extends in a direction intersecting the interface.

6. The exhaust manifold of claim 1, wherein an angle formed between the swirl groove and the inclined surface is larger than 90 degrees.

* * * * *